US005792026A

United States Patent [19]

Maresh et al.

[11] Patent Number: 5,792,026

[45] Date of Patent: Aug. 11, 1998

[54] EXERCISE METHOD AND APPARATUS

[76] Inventors: Joseph D. Maresh, 19919 White Cloud Cir., West Linn, Oreg. 97068; Kenneth W. Stearns, 8009 Cedel, Houston, Tex. 77055

[21] Appl. No.: 818,248

[22] Filed: Mar. 14, 1997

[51] Int. Cl.[6] ..... A63B 69/16; A63B 22/04

[52] U.S. Cl. ..... 482/51; 482/57; 482/70

[58] Field of Search ..... 482/51, 52, 53, 482/57, 62, 70, 79, 80

[56] References Cited

U.S. PATENT DOCUMENTS

| | | | |
|---|---|---|---|
| 4,185,622 | 1/1980 | Swenson | 128/25 B |
| 4,786,050 | 11/1988 | Geschwender | 272/73 |
| 5,186,697 | 2/1993 | Rennex | 482/52 |
| 5,242,343 | 9/1993 | Miller | 482/57 |
| 5,279,529 | 1/1994 | Eschenbach | 48/57 |
| 5,290,212 | 3/1994 | Metcalf | 482/62 |
| 5,295,928 | 3/1994 | Rennex | 482/52 |
| 5,352,169 | 10/1994 | Eschenbach | 482/57 |
| 5,383,829 | 1/1995 | Miller | 482/57 |
| 5,397,286 | 3/1995 | Chang | 482/62 |
| 5,423,729 | 6/1995 | Eschenbach | 482/70 |
| 5,453,066 | 9/1995 | Richter, Jr. | 482/57 |
| 5,518,473 | 5/1996 | Miller | 482/57 |
| 5,529,554 | 6/1996 | Eschenbach | 482/57 |
| 5,529,555 | 6/1996 | Rodgers, Jr. | 482/57 |
| 5,540,637 | 7/1996 | Rodgers | 482/51 |
| 5,549,526 | 8/1996 | Rodgers, Jr. | 482/57 |
| 5,562,574 | 10/1996 | Miller | 482/51 |
| 5,573,480 | 11/1996 | Rodgers, Jr. | 482/57 |
| 5,577,985 | 11/1996 | Miller | 482/51 |
| 5,593,371 | 1/1997 | Rodgers | 482/51 |
| 5,637,058 | 6/1997 | Rodgers, Jr. | 482/51 |
| 5,685,804 | 11/1997 | Whan-Tong et al. | 482/51 |

*Primary Examiner*—Stephen R. Crow

[57] ABSTRACT

An exercise apparatus includes a force receiving member movable relative to a frame. A first link is rotatably interconnected between a first crank and a rearward portion of the force receiving member, and a second link is rotatably interconnected between a second crank and an intermediate portion of the force receiving member. The cranks and the links cooperate to move the force receiving member in a desired path.

35 Claims, 5 Drawing Sheets

FIG. 3
FIG. 3a
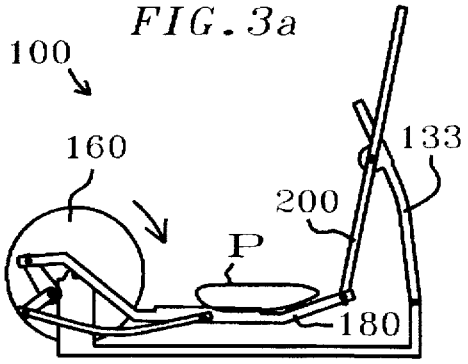
FIG. 3b
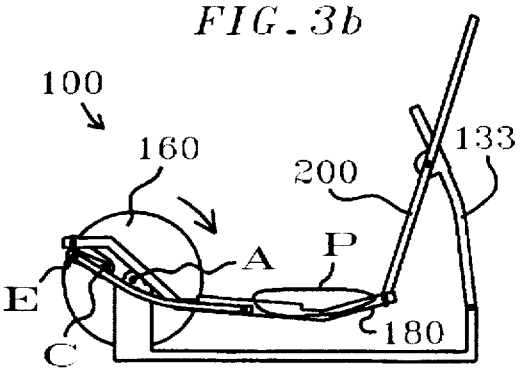
FIG. 3c
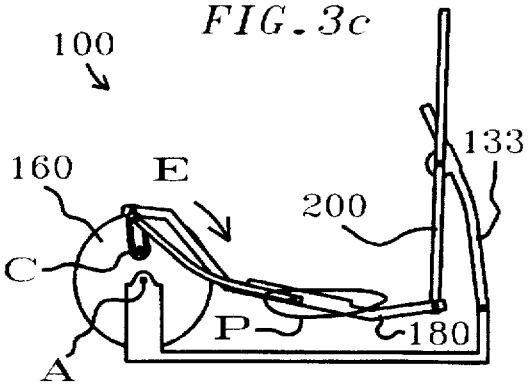
FIG. 3d
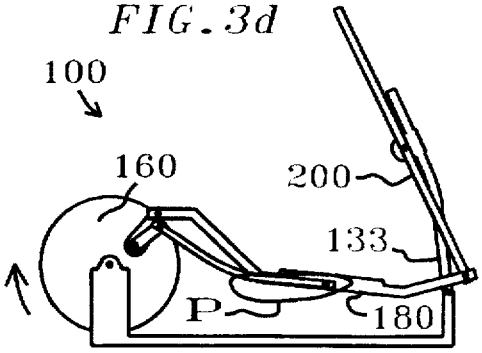
FIG. 3e
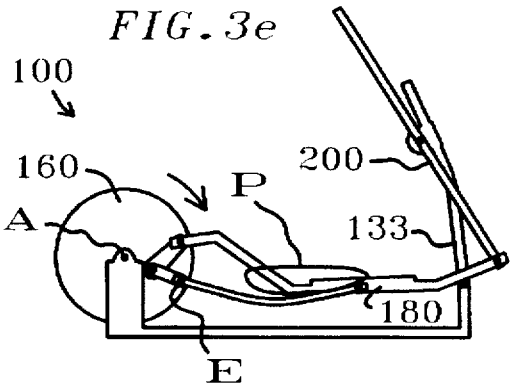
FIG. 3f
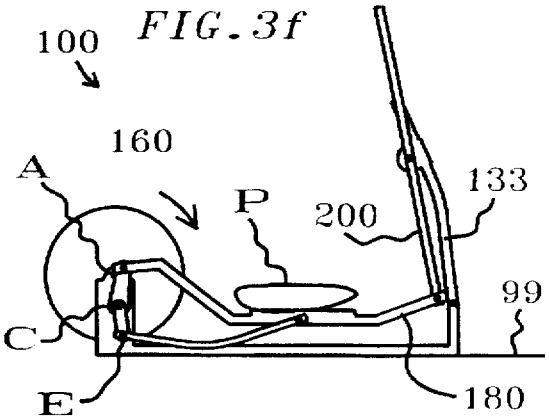

EXERCISE METHOD AND APPARATUS

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Some examples of such equipment may be found in United States patents which are disclosed in an Information Disclosure Statement submitted herewith.

Exercise equipment has also been designed to facilitate full body exercise. For example, reciprocating cables or pivoting arm poles have been used on many of the equipment types discussed in the preceding paragraph to facilitate contemporaneous upper body and lower body exercise. Some examples of such equipment may be found in United States patents which are disclosed in an Information Disclosure Statement submitted herewith.

SUMMARY OF THE INVENTION

In one respect, the present invention may be seen to provide a novel linkage assembly and corresponding exercise apparatus suitable for linking circular motion to relatively more complex, generally elliptical motion. In particular, a forward portion of a foot platform (or other force receiving member) is movably connected to a frame; a rearward portion of the foot platform is rotatably connected to a first link; a discrete portion of the first link is rotatably connected to a flywheel (or other crank member); a second link is rotatably connected to the flywheel; and a discrete portion of the second link is rotatably connected to an intermediate portion of the foot platform. As the flywheel rotates, the two links constrain the foot platform to travel through a generally elliptical path.

In another respect, the present invention may be seen to provide a novel linkage assembly and corresponding exercise apparatus suitable for linking reciprocal motion to relatively more complex, generally elliptical motion. In particular, a third link is rotatably connected to a frame member; a discrete, relatively lower portion of the third link is rotatably connected to the forward portion of the foot platform (generally opposite the portion connected to the first link); a relatively lower portion of a handle member is rotatably connected to the frame member; and a pin is provided to selectively secure the handle member to either the frame member or the third link. In the latter case, as the foot platform moves through its generally elliptical path, the handle member pivots back and forth.

In yet another respect, the present invention may be seen to provide a novel linkage assembly and corresponding exercise apparatus suitable for adjusting the angle of the generally elliptical path of motion relative to a horizontal surface on which the apparatus rests. In particular, a lower portion of the third link is rotatably connected to the forward portion of the foot platform (generally opposite the portion connected to the first link); a discrete, upper portion of the third link is rotatably connected to a sliding member on the frame of the apparatus; and a pin extends through the sliding member and into engagement with one of a plurality of holes in the frame to selectively secure the sliding member at a particular elevation above the horizontal surface. A relatively higher pin location results in a relatively more strenuous, "uphill" exercise motion.

BRIEF DESCRIPTION OF THE DRAWING

With reference to the Figures of the Drawing, wherein like numerals represent like parts and assemblies throughout the several views.

FIG. 3*a* is a side view of the exercise apparatus of FIG. 1, showing only one of the two linkage assemblies in a first position;

FIG. 3*b* is a side view of the exercise apparatus of FIG. 1, showing the linkage assembly of FIG. 3*a* in a second position (the flywheel having rotated sixty degrees from the orientation shown in FIG. 3*a*);

FIG. 3*c* is a side view of the exercise apparatus of FIG. 1, showing the linkage assembly of FIG. 3*a* in a third position (the flywheel having rotated sixty degrees from the orientation shown in FIG. 3*b*);

FIG. 3*d* is a side view of the exercise apparatus of FIG. 1, showing the linkage assembly of FIG. 3*a* in a fourth position (the flywheel having rotated sixty degrees from the orientation shown in FIG. 3*c*);

FIG. 3*e* is a side view of the exercise apparatus of FIG. 1, showing the linkage assembly of FIG. 3*a* in a fifth position (the flywheel having rotated sixty degrees from the orientation shown in FIG. 3*d*);

FIG. 3*f* is a side view of the exercise apparatus of FIG. 1, showing the linkage assembly of FIG. 3*a* in a sixth position (the flywheel having rotated sixty degrees from the orientation shown in FIG. 3*e*);

DETAILED DESCRIPTION OF THE PREFERRED EMBODIMENT

Figure 1:
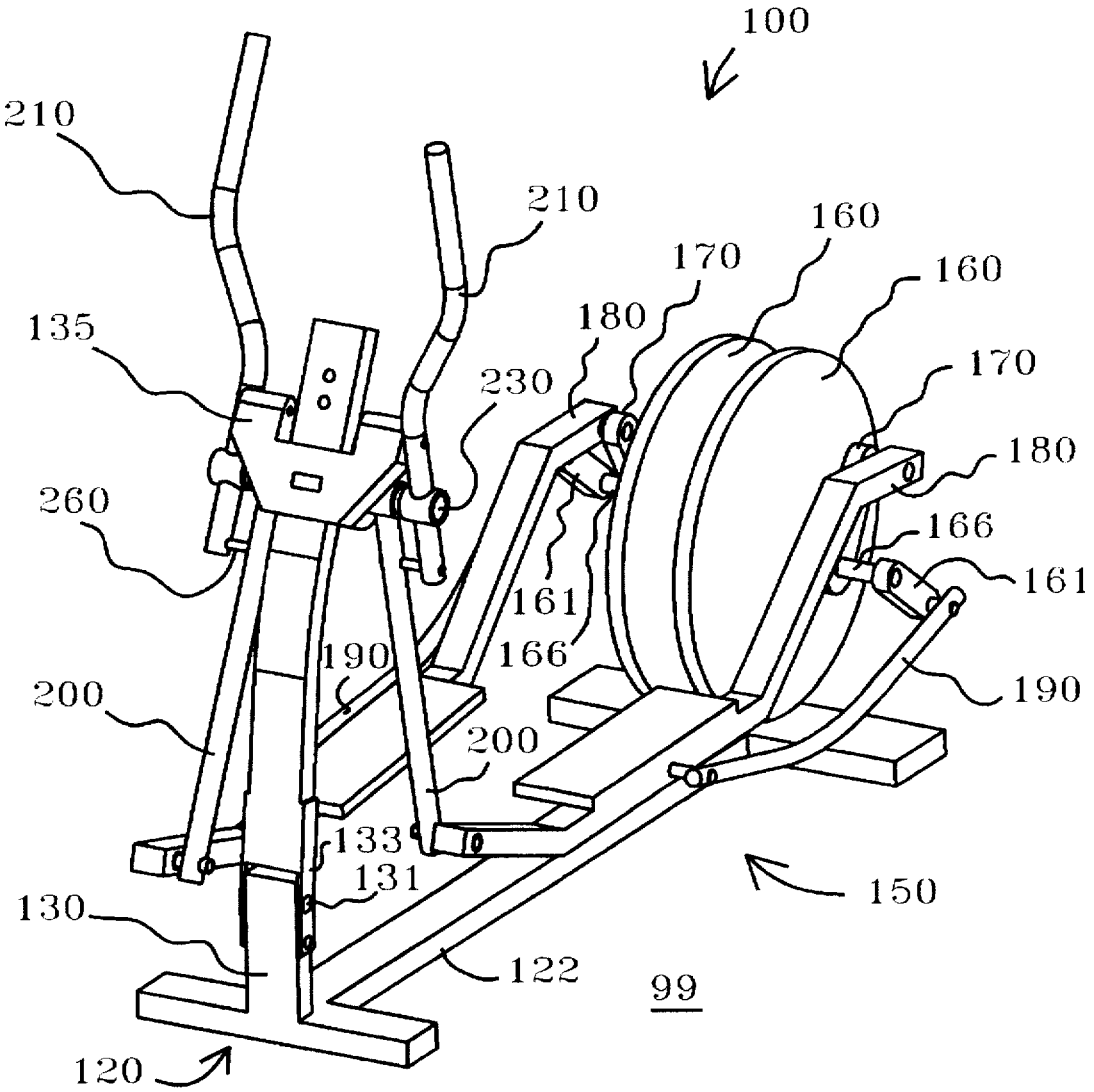
FIG. 1 is a perspective view of an exercise apparatus constructed according to the principles of the present invention.

A preferred embodiment exercise apparatus constructed according to the principles of the present invention is designated as 100 in FIGS. 1–5. The apparatus 100 generally includes a frame 120 and a linkage assembly 150 movably mounted on the frame 120. Generally speaking, the linkage assembly 150 moves relative to the frame 120 in a manner that links rotation of a flywheel 160 to generally elliptical motion of a force receiving member 180, and/or that links generally elliptical motion of the force receiving member to reciprocal pivoting motion of a suspension member 200. As shown in FIGS. 3*a*–3*f*, the force receiving member 180 travels through a curve designated as P, which is traced by following the approximate midpoint of a support surface on the force receiving member 180 as the flywheel 160 rotates through one complete cycle.

The frame 120 includes a base 122, a forward stanchion 130, and a rearward stanchion 140. The base 122 may be described as generally I-shaped and is designed to rest upon a generally horizontal floor surface 99. The apparatus 100 is generally symmetrical about a vertical plane extending lengthwise through the base 122 (perpendicular to the transverse ends thereof), the only exception being the relative orientation of certain parts of the linkage assembly 150 on opposite sides of the plane of symmetry. Thus, like reference numerals are used to designate both the "right-hand" and "left-hand" parts on the apparatus 100, and when reference is made to parts on only one side of the apparatus, it is to be understood that similar parts are disposed on the opposite side of the apparatus 100. Those skilled in the art will also recognize that the portions of the frame 120 which are intersected by the plane of symmetry exist individually and thus, do not have any "opposite side" counterparts. Furthermore, to the extent that reference is made to "forward" or "rearward" portions of the apparatus 100, it is to be understood that a person could exercise on the apparatus 100 while facing in either direction relative to the linkage assembly 150.

Figure 4:
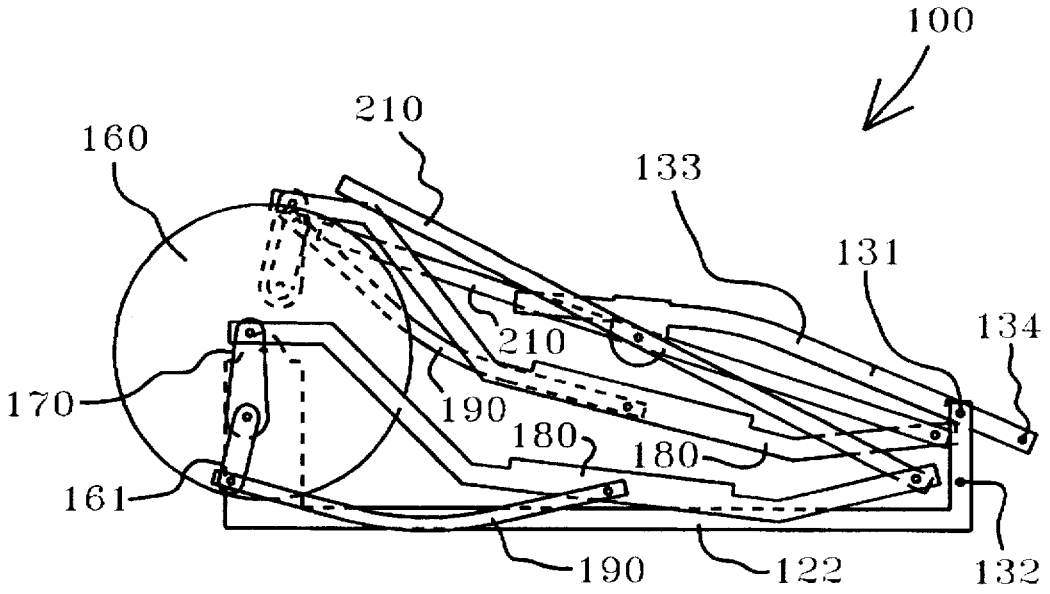
FIG. 4 is a side view of the exercise apparatus of FIG. 1, showing the apparatus in a collapsed configuration.
Figure 5:
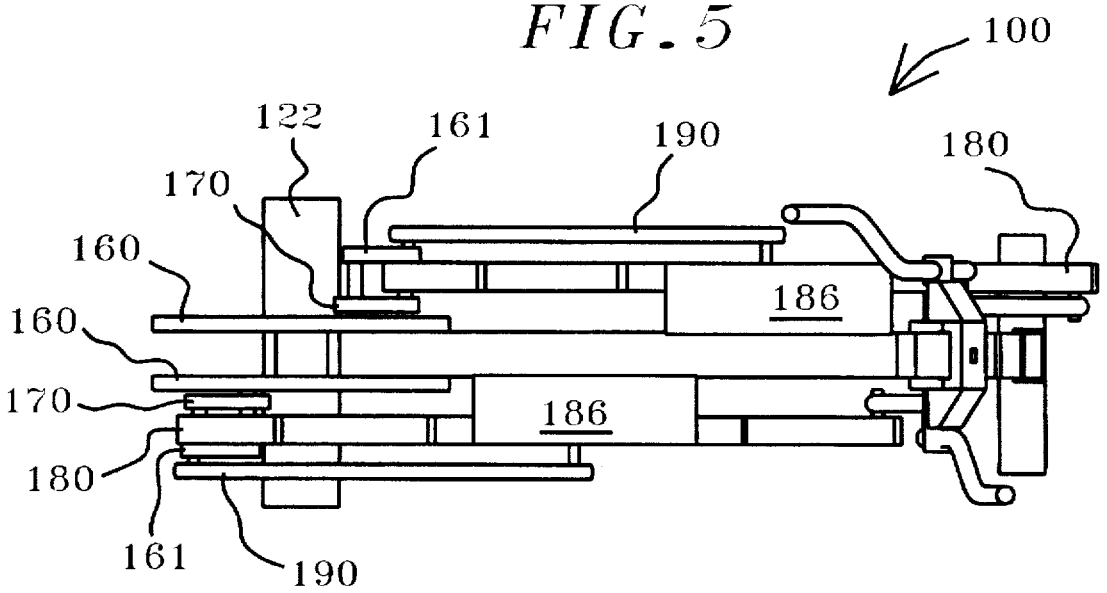
FIG. 5 is a top view of the exercise apparatus of FIG. 1.

The forward stanchion 130 extends perpendicularly upward from the base 122 and supports a post 133. In the preferred embodiment 100, holes (not numbered) are formed through overlapping portions of the post 133 and the stanchion 130 to receive a first bolt 131 (or other suitable fastener) which rotatably connects the post 133 to the stanchion 130. Additional holes 132 and 134 (see FIG. 4) are formed through discrete overlapping portions of the post 133 and the stanchion 130 to receive a second bolt (not numbered) which selectively locks the post 133 in a generally upright orientation relative to the floor surface 99. As shown in FIG. 4, the second fastener may be removed to render the post 133 "collapsible" relative to the remainder of the frame 120.

Figure 2:
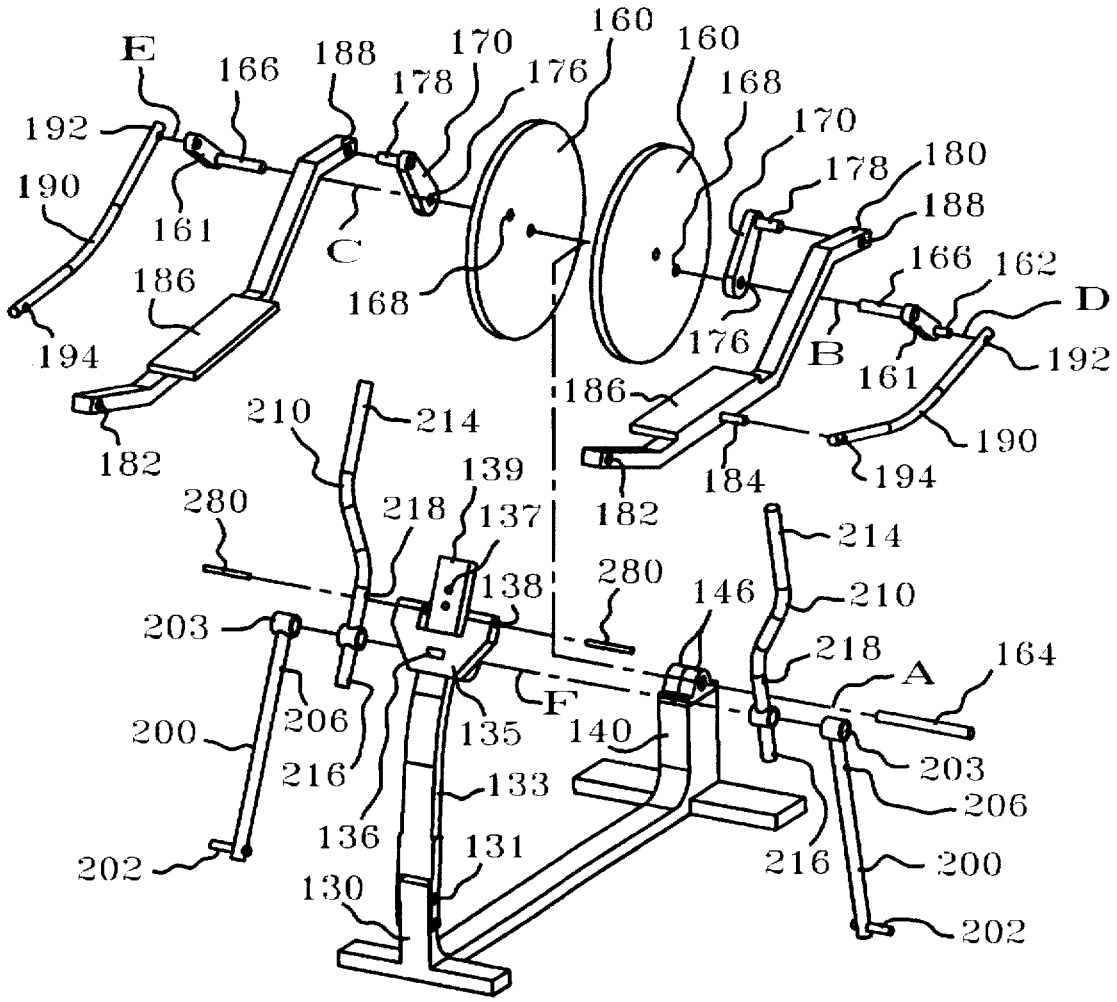
FIG. 2 is an exploded perspective view of the exercise apparatus of FIG. 1.

As shown in FIG. 2, the rearward stanchion 140 extends perpendicularly upward from the base 122 and supports a pair of bearing assemblies 146. An axle 164 is inserted through holes (not numbered) in the bearing assemblies 146 to support a pair of flywheels 160 in a manner known in the art. For example, the axle 164 may be inserted through the bearing assemblies 146, and then one of the flywheels 160 may be fixed to each of the protruding ends of the axle 164, on opposite sides of the stanchion 140. Those skilled in the art will recognize that the flywheels 160 could be replaced by some other rotating member(s) which may or may not, in turn, be connected to one or more flywheels. These rotating members 160 rotate about an axis designated as A.

A radially displaced shaft 166 is rigidly secured to each flywheel 160 by means known in the art. For example, the shaft 166 may be inserted into a hole 168 in the flywheel 160 and welded in place. The shaft 166 is secured to the flywheel 160 at a point radially displaced from the axis A, and thus, the shaft 166 rotates at a fixed radius about the axis A. In other words, the shaft 166 and the flywheel 160 cooperate to define a first crank having a first crank radius.

First links 170 have first ends rotatably connected to respective shafts 166 by means known in the art. For example, a hole 176 may be formed through each first link 170, and respective shafts 166 may be inserted through the holes 176. As a result of this arrangement, the first link 170 on one side of the apparatus 100 pivots or rotates about an axis B relative to its respective shaft 166 and flywheel 160; and the first link 170 on the other side of the apparatus 100 pivots or rotates about an axis C relative to its respective shaft 166 and flywheel 160.

First links 170 have second, opposite ends rotatably connected to rearward ends of respective force receiving members 180 by means known in the art. For example, in each case, a pin 178 may be secured to the first link 170, and a hole 188 may be formed through the force receiving member 180, proximate the rear end thereof, to receive the pin 178. As a result of this arrangement, the first link 170 may be said to be rotatably interconnected between the flywheel 160 and the force receiving member 180, and/or to provide a means for interconnecting the flywheel 160 and the force receiving member 180.

A rigid member 161 is fixedly secured to each shaft 166 by means known in the art. A pin 162 is secured to an opposite end of each rigid member 161 and extends away from a respective flywheel 160. Thus, the pin 162 occupies a position radially displaced from the axis A and rotates at a fixed radius about the axis A. In other words, the pin 162 and the flywheel 160, together with the parts interconnected therebetween, cooperate to define a second crank having a second, relatively greater crank radius. Those skilled in the art will recognize that the second crank and the first crank are portions of a single unitary member and share a common rotational axis A.

A second link 190 has a rearward end 192 rotatably connected to the pin 162 by means known in the art. For example, a hole may be formed through the rearward end 192 of the second link 190, and the pin 162 may be inserted through the hole. As a result of this arrangement, the second link 190 on one side of the apparatus 100 rotates about an axis D relative to its respective pin 162 and flywheel 160; and the second link 190 on the other side of the apparatus 100 rotates about an axis E relative to its respective pin 162 and flywheel 160.

Each second link 190 has a forward end 194 rotatably connected to an intermediate portion of a respective force receiving member 180 by means known in the art. For example, a pin 184 may be secured to the force receiving member 180, and a hole may be formed through the forward end 194 of the second link 190 to receive the pin 184. As a result of this arrangement, the second link 190 may be said to be rotatably interconnected between the flywheel 160 and the force receiving member 180, and/or to provide a discrete means for interconnecting the flywheel 160 and the force receiving member 180.

Each force receiving member 180 has a forward end, a rearward end (connected to the first link 170), and an intermediate portion (connected to the second link 190). The intermediate portion provides a support surface 186 which is sized and configured to support at least one foot of a person using the apparatus 100. When the force receiving member 180 is oriented so that the intermediate portion extends horizontally (see FIG. 3*f*), the forward end and the rearward end are upwardly displaced from the intermediate portion (higher above the floor surface 99).

The forward end of each force receiving member 180 is movably connected to the frame 120, forward of the flywheels 160. In particular, each forward end is rotatably connected to a respective third link or generally vertical, suspension member 200 by means known in the art. For example, a hole 182 may be formed through the forward end of each force receiving member 180 to receive a pin 202 extending from a respective vertical member 200, proximate its lower end. Each vertical member 200 is rotatably connected to a frame member or yoke 135 by means known in the art. For example, a collar 203 may be secured to the vertical member 200, proximate its upper end, to receive a shaft 230 (see FIG. 1) extending laterally outward from the frame member 135. The forward ends of the foot platforms 180 pivot about an axis F defined by the longitudinal axis of the shaft 230. As a result of this arrangement, the third link 200 may be said to be rotatably interconnected between the force receiving member 180 and the frame 120, and/or to provide a means for interconnecting the force receiving member 180 and the frame 120.

As shown in FIG. 2, the frame member 135 is slidably mounted on the post 133, between an upper distal end 139 and a pair of outwardly extending shoulders, nearer the lower, pivoting end. A spring-loaded pin 136 (or other suitable fastener) extends through the frame member 135 and into engagement with any of a plurality of holes 137 in the post 133 to selectively lock the frame member 135 at one of a plurality of positions along the post 133 (and above the floor surface 99). The inclination of the path traveled by the force receiving members 180 is a function of the height of the pivot axis F of the vertical members 200 above the floor surface 99. In other words, the difficulty of exercise can be increased simply by locking the frame member 135 in a relatively higher position on the post 133.

Handle members 210 are also rotatably connected to opposite ends of the shaft 230 and thus, share a common pivot axis F with the suspension members 200. The handle members 210 include upper, distal portions 214 which are sized and configured for grasping by a person standing on the force receiving members 180. A hole 216 is formed through each handle member 210, proximate its lower end (and beneath the pivot axis F), and a corresponding hole 206 is formed through each suspension member 200 an equal radial distance away from the pivot axis F. Pins 260 (see FIG. 1) may be inserted through aligned holes 206 and 216 to interconnect the suspension members 200 and the handle members 210 and thereby constrain each pinned combination to pivot as a unit about the pivot axis F. As a result of this arrangement, the pins 260 may be said to be selectively interconnected between respective handle members 210 and suspension members 200, and/or to provide a means for selectively linking the handle members 210 and the suspension members 200. Moreover, the pins 260 may be seen to cooperate with the suspension members 200 to provide a means for selectively linking the handle members 210 and the force receiving members 180.

Another hole 218 is formed through each handle member 210, approximately an equal distance above the pivot axis F, and corresponding holes 138 are formed in the frame member 135 an equal distance away from the pivot axis F. Pins 280 (see FIG. 2) may be inserted through aligned holes 218 and 138 to interconnect the handle members 210 and the frame member 135 and thereby lock the former in place relative to the latter. In other words, the pins 280 may be seen to provide a means for selectively locking the handle members 210 to the frame 120. For purposes of clarity, the preferred embodiment 100 is shown and described with reference to discrete sets of pins 260 and 280. However, the holes 206, 216, 218, and 138 are all of like diameter, and a single, common set of pins could be provided in lieu of separate pins 260 and 280, to reduce the cost of manufacturing the apparatus 100 and/or to ensure that the handle members 210 are not simultaneously connected to both the vertical members 200 and the frame member 135.

Those skilled in the art will also recognize that the exercise apparatus 100 facilitates three different modes of exercise as between the upper body and the lower body. In a first mode of operation or configuration, the pins 260 are removed, and the pins 280 are inserted. With the suspension members 200 free to pivot independent of the handle members 210, and the handle members 210 locked to the frame 120, a person may grasp the stationary handle members 210 for support while moving the feet and legs through the generally elliptical path of motion. In a second mode of operation or configuration, both sets of pins 260 and 280 are removed. With the suspension members 200 free to pivot independent of the handle members 210, and the handle members 210 free to pivot independent of the suspension members 200, a person may grasp the handle members 210 and selectively move same while moving the feet and legs through the generally elliptical path of motion. In a third mode of operation or configuration, the pins 280 are removed, and the pins 260 are inserted. With the handle members 210 free to pivot relative to the frame 120 and constrained to pivot together with the suspension members 200, movement of the feet and legs through the generally elliptical path of motion causes the handle members 210 to pivot back and forth. In this third mode of operation, a person may grasp the handle members 210 and choose to simply allow the handle members 210 to follow the prescribed path of motion, or help drive the handle members 210 through the prescribed path of motion, or provide resistance to movement of the handle members 210 through the prescribed path of motion.

As shown in FIGS. 3*a*–3*f*, rotation of a flywheel 160 causes generally elliptical movement of a respective foot platform 180. For the particular size, configuration, and arrangement of linkage assembly components on the preferred embodiment 100, it can be seen that the first link 170 oscillates through a range of approximately 90 degrees as the flywheel 160 rotates through 360 degrees. Also, the rear end of the foot platform 180 reaches a low point relative to the floor surface 99 when the crank axis C is disposed directly beneath the flywheel axis A (see FIG. 3*f*), and a high point relative to the floor surface 99 when the crank axis C is disposed directly above the flywheel axis A (see FIG. 3*c*). In other words, the vertical component or minor axis of the elliptical path of motion is approximately equal to twice the radial distance between the flywheel axis A and the crank axis C.

The second link 190 oscillates through a lesser range as the flywheel 160 rotates through 360 degrees, and the foot platform 180 reaches a forwardmost point relative to the frame 120 when the crank axis E is disposed directly forward of the flywheel axis A (see FIG. 3*e*), and a rearwardmost point relative to the frame 120 when the crank axis E is disposed directly rearward of the flywheel axis A (see FIG. 3*b*). In other words, the horizontal component or major axis of the elliptical path of motion is approximately equal to twice the radial distance between the flywheel axis A and the crank axis E. Given this general relationship between crank radii and components of motion, it is a relatively simple matter to design an apparatus with a desired "aspect ratio" for the elliptical path to be traveled by the foot platform. In other words, the exact size, configuration, and arrangement of the components of the linkage assembly 150 are a matter of design choice.

In FIGS. 3*a*–3*f*, one side of the linkage assembly 150 is shown at points corresponding to clockwise rotation of the flywheel 160 through increments of 60 degrees. Some of the spacial relationships between various components of the apparatus 100 may be observed with reference to the orientation of the suspension member 200. As shown in FIG. 3*c*, for example, when the suspension member 200 occupies an approximately vertical orientation, a line extending through the corresponding axes A and C is generally vertical; a line extending through the corresponding axes A and E is also generally vertical; and a line extending through the corresponding axis A and the second end of the corresponding first link 170 is generally vertical, as well. For purposes of describing spatial relationships among and between the parts of the apparatus 100, "generally" or "substantially" vertical is intended to mean within six degrees of vertical; "generally" or "substantially" parallel is intended to mean defining an angle of no more than six degrees therebetween or an angle of at least one hundred seventy-four degrees therebetween; and "generally" or "substantially" between is intended to mean that a first line drawn between the intermediate entity and one extreme entity cooperates with a second line drawn between the intermediate entity and the other, opposite extreme entity to define an angle of at least one hundred seventy-four degrees.

Each of the components of the linkage assembly 150 is sufficiently long to facilitate the depicted interconnections. For example, each of the links 170 and 190 must be long enough to interconnect the flywheel and the force receiving member and accommodate a particular crank radius. Also, for ease of reference, the components are sometimes described with reference to "ends" being connected to other parts. For example, both the first link 170 and the second link 190 may be said to have a first end rotatably connected to the flywheel and a second end rotatably connected to the force receiving member. However, those skilled in the art will recognize that the present invention is not limited to links which terminate immediately beyond their points of connection with other parts. In other words, the term "end" should be interpreted broadly, in a manner that could include "rearward portion", for example; and in a manner wherein "rear end" could simply mean "behind intermediate portion", for example.

Figure 6:
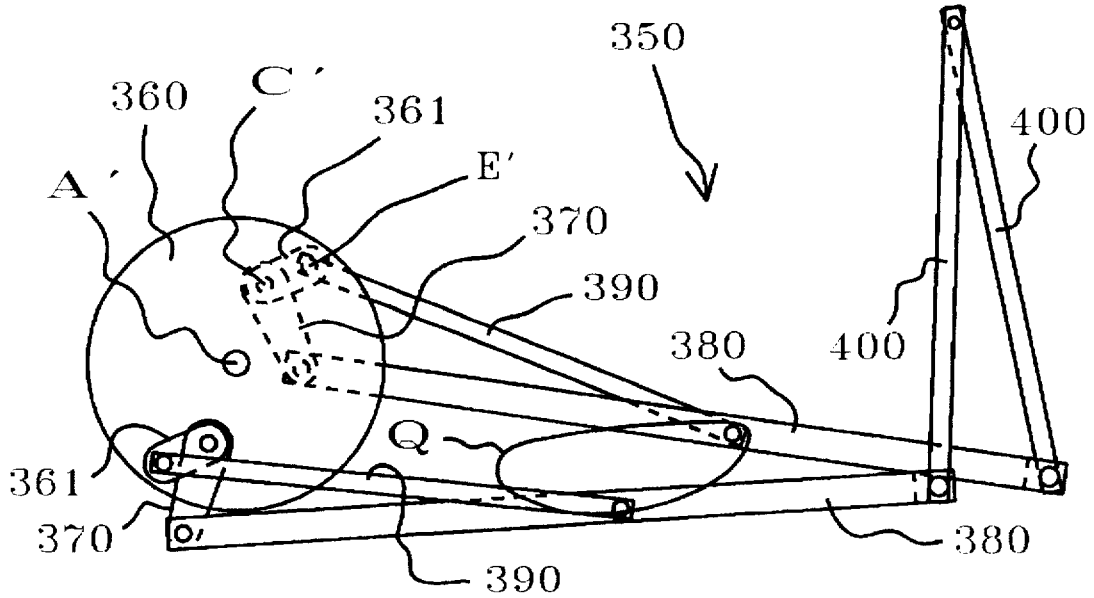
FIG. 6 is a side view of another exercise apparatus constructed according to the principles of the present invention.

Although the present invention has been described with reference to a preferred embodiment and a particular application, those skilled in the art will recognize additional embodiments, modifications, and/or applications which fall within the scope of the present invention. For example, an alternative embodiment linkage assembly constructed according to the principles of the present invention is designated as 350 in FIG. 6. The alternative embodiment linkage assembly 350 is similar in many respects to the linkage assembly 150 of the preferred embodiment 100. However, the first links 370 support the force receiving members 380 in "suspended" fashion and thus, may be either rigid or flexible. In this linkage assembly 350, the first links 370 are flexible and have looped ends which are rotatably connected to respective flywheels 360 and respective force receiving members 380. The second links 390 are rigid and are rotatably interconnected between respective flywheels 360 and respective force receiving members 380. Rigid members 361 offset respective axes E' from respective axes C' (both radially and circumferentially). Suspension members 400 are rotatably interconnected between respective force receiving members 380 and the frame. Rotation of the flywheels 360 causes the respective force receiving members 380 to travel through the path of motion Q.

Figure 7:
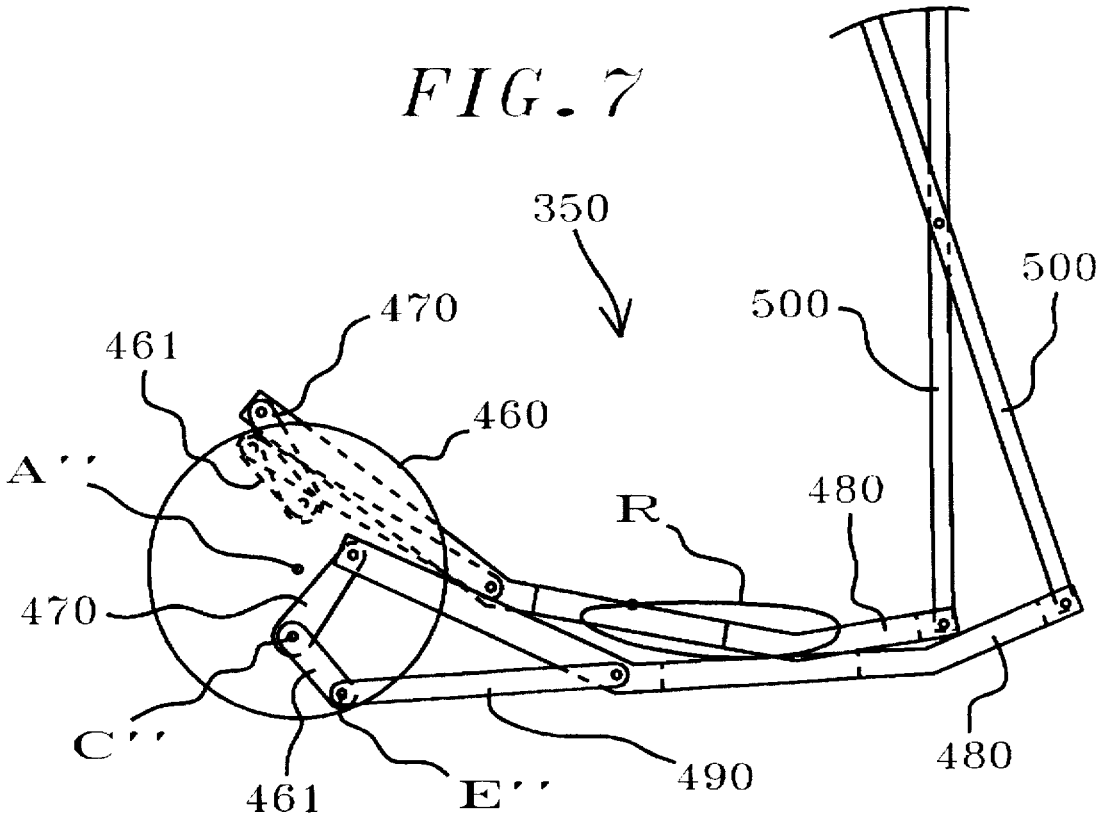
FIG. 7 is a side view of yet another exercise apparatus constructed according to the principles of the present invention.

Those skilled in the art will also recognize that the spatial relationships, including the radii and/or angular displacement of the crank axes, may vary for different sizes, configurations, and/or arrangements of the components of the linkage assembly 150. For example, another alternative embodiment linkage assembly constructed according to the principles of the present invention is designated as 450 in FIG. 7. The alternative embodiment linkage assembly 450 is similar in many respects to the linkage assembly 150 of the preferred embodiment 100. However, the second links 490 are relatively shorter, and the first links 470 are relatively longer. The rigid members 461 are also relatively longer and provide a different offset between respective axes E" and respective axes C" (both radially and circumferentially). Suspension members 500 are rotatably interconnected between respective force receiving members 480 and the frame. Rotation of the flywheels 460 causes the respective force receiving members 480 to travel through the path of motion R.

Those skilled in the art will further recognize that the forward ends of the horizontal members 180 could be movably connected to the frame 120 by means of rollers and ramps, rather than the pivoting suspension members 200. Also, the present invention could be fitted with any of various known inertia altering devices, including, for example, a motor, a "stepped up" flywheel, or an adjustable brake of some sort. Furthermore, although the rotationally interconnected components are shown to be simply cantilevered relative to one another on the preferred embodiment 100, the components could be modified so that an end of a first component, such as the suspension member 200, nested between opposing prongs on the end of a second component, such as the force receiving member 180.

Recognizing that the foregoing description sets forth only a few of the numerous possible modifications and variations that will become apparent to those skilled in the art, the scope of the present invention is to be limited only to the extent of the claims which follow.

What is claimed is:

1. An exercise apparatus, comprising:

a frame having a longitudinal axis, and on each side of the longitudinal axis, the exercise apparatus further comprising:

a crank rotatably mounted on the frame and rotatable about a crank axis;

a first link having a first end and a second end, wherein the first end is rotatably connected to the crank at a position radially displaced from the crank axis and is rotatable about a first link axis;

a force receiving member having a front end, a rear end, and an intermediate portion extending therebetween, wherein the front end is movable in reciprocal fashion relative to the frame, and the rear end is rotatably connected to the second end of the first link, and the intermediate portion is sized and configured to support a foot of a standing person; and a second link having a first end and a second end, wherein the first end of the second link is rotatably connected to the intermediate portion of the force receiving member, and the second end of the second link is rotatably connected to the crank at a position radially displaced from the crank axis and is rotatable about a second link axis.

2. The exercise apparatus of claim 1, wherein the first link axis is disposed generally between the crank axis and the second link axis.

3. The exercise apparatus of claim 1, wherein the crank includes a flywheel.

4. The exercise apparatus of claim 1, wherein the crank includes a radially displaced shaft extending in a generally axial direction, and the first end of the first link is rotatably connected to the shaft.

5. The exercise apparatus of claim 4, wherein a rigid member is fixed to the shaft and extends generally perpendicular thereto, and the second end of the second link is rotatably connected to the rigid member at a position radially displaced from the shaft.

6. The exercise apparatus of claim 5, wherein the first link is retained between the crank and the rigid member.

7. The exercise apparatus of claim 5, wherein when the rigid member occupies a generally vertical orientation, the first link extends substantially parallel thereto.

8. The exercise apparatus of claim 1, wherein when the intermediate portion of the force receiving member extends horizontally, the rear end is upwardly displaced from the intermediate portion.

9. The exercise apparatus of claim 1, further comprising a suspension member rotatably connected to the frame forward of the crank and rotatable about a pivot axis, wherein the front end of the force receiving member is rotatably connected to the suspension member at a point beneath the pivot axis.

10. The exercise apparatus of claim 9, further comprising a handle member rotatably connected to the frame and within reach of a person standing on the force receiving member; and means for selectively linking the handle member to the suspension member.

11. The exercise apparatus of claim 10, wherein the means includes a pin sized and configured to insert through aligned holes in the handle member and the suspension member.

12. The exercise apparatus of claim 9, wherein when the suspension member pivots to a vertical orientation, a line extending perpendicularly through the crank axis and the second link axis is substantially vertical.

13. The exercise apparatus of claim 9, wherein when the suspension member pivots to a vertical orientation, a line extending perpendicularly through the crank axis and the first link axis is substantially vertical.

14. The exercise apparatus of claim 9, wherein a first frame member is selectively movable relative to a second frame member to position the pivot axis at different elevations.

15. The exercise apparatus of claim 1, further comprising a handle member rotatably connected to the frame and within reach of a person standing on the force receiving member; and means for selectively linking movement of the force receiving member to movement of the handle member.

16. An exercise apparatus, comprising:

a frame having a longitudinal axis, and on each side of the longitudinal axis, the exercise apparatus further comprising:

a first crank rotatably mounted on the frame and rotatable about a first crank axis;

a second crank rotatably mounted on the frame and rotatable about a second crank axis;

a force receiving member having a front end, a rear end, and an intermediate portion extending therebetween, wherein the force receiving member is sized and configured to support a foot of a standing person and the front end is movable in reciprocal fashion relative to the frame;

a first link rotatably interconnected between the first crank and the rear end of the force receiving member; and a second link rotatably interconnected between the second crank and the intermediate portion of the force receiving member.

17. The exercise apparatus of claim 16, wherein the first crank defines a first crank radius, and the second crank defines a second, relatively greater crank radius.

18. The exercise apparatus of claim 16, wherein the first crank and the second crank are portions of a single unitary member and share a common crank axis.

19. The exercise apparatus of claim 16, further comprising a suspension member rotatably connected to the frame, forward of the first crank and the second crank, and rotatable about a pivot axis, wherein the force receiving member is rotatably connected to the suspension member at a point proximate the front end and beneath the pivot axis.

20. The exercise apparatus of claim 19, further comprising a handle member movably connected to the frame; and a pin radially displaced from the pivot axis and interconnected between the suspension member and the handle member.

21. The exercise apparatus of claim 19, further comprising a handle member movably connected to the frame; and a pin sized and configured to insert through aligned holes in the suspension member and the handle member, and sized and configured to insert through aligned holes in the handle member and the frame.

22. The exercise apparatus of claim 19, wherein a first frame member is selectively movable relative to a second frame member to position the pivot axis at different elevations.

23. The exercise apparatus of claim 16, further comprising a handle movably connected to the frame; and a means for linking movement of the force receiving member to movement of the handle.

24. The exercise apparatus of claim 16, further comprising a handle movably connected to the frame; and a means for selectively linking movement of the force receiving member to movement of the handle, and for selectively locking the handle in place relative to the frame.

25. An exercise apparatus, comprising:

a frame having a longitudinal axis, and on each side of the longitudinal axis, the exercise apparatus further comprising:

a crank rotatably mounted on the frame;

a force receiving member sized and configured to support a foot of a standing person and having a first portion which is movable in reciprocal fashion relative to the frame;

a first means, rotatably interconnected between a second portion of the force receiving member, spaced apart from the first portion, and a first location on the crank, for linking rotation of the crank to movement of the force receiving member; and a second means, rotatably interconnected between a third portion of the force receiving member, spaced apart from the first portion and the second portion, and a second location on the crank, spaced apart from the first location, for linking rotation of the crank to movement of the force receiving member.

26. The exercise apparatus of claim 25, further comprising a handle member; and a third means, interconnected between the force receiving member and the handle member, for linking movement of the force receiving member to movement of the handle member.

27. The exercise apparatus of claim 26, wherein the third means includes a link having a relatively lower portion rotatably connected to the force receiving member proximate a front end thereof, and having a relatively higher portion rotatably connected to the frame.

28. The exercise apparatus of claim 25, further comprising a link having a relatively lower portion rotatably connected to the force receiving member proximate a front end thereof, and having a relatively higher portion rotatably connected to the frame.

29. The exercise apparatus of claim 28, wherein the higher portion is rotatably connected to a yoke, and the yoke is slidably connected to the frame and selectively locked in one of a plurality of positions along the frame.

30. The exercise apparatus of claim 29, further comprising a handle rotatably connected to the yoke.

31. The exercise apparatus of claim 30, further comprising a third means, selectively interconnected between the handle and the link, for selectively constraining the handle and the link to rotate together about a common axis.

32. The exercise apparatus of claim 25, wherein the first means includes a first link rotatably connected to a rearward portion of the force receiving member, and rotatably connected to the crank at a first radial distance from an axis of rotation defined by the crank.

33. The exercise apparatus of claim 32, wherein the second means includes a second link rotatably connected to an intermediate portion of the force receiving member, and rotatably connected to the crank at a second, relatively greater radial distance from the axis of rotation defined by the crank.

34. The exercise apparatus of claim 32, wherein the first link is flexible.

35. The exercise apparatus of claim 34, wherein the second means includes a rigid link rotatably connected to an intermediate portion of the force receiving member, and rotatably connected to the crank at a second, relatively greater radial distance from the axis of rotation defined by the crank.

* * * * *